US006205302B1

(12) United States Patent
Yokota

(10) Patent No.: US 6,205,302 B1
(45) Date of Patent: Mar. 20, 2001

(54) COOLING DEVICE FOR IMAGE FORMING APPARATUS

(75) Inventor: Eiji Yokota, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 08/780,157

(22) Filed: Dec. 26, 1996

(30) Foreign Application Priority Data

Feb. 15, 1996 (JP) ..... 8-28229

(51) Int. Cl.[7] ..... G03G 15/00; G03G 21/00
(52) U.S. Cl. ..... 399/92; 347/152; 361/695
(58) Field of Search ..... 399/91, 92, 93; 355/30; 361/695, 696; 400/679; 347/138, 152

(56) References Cited

U.S. PATENT DOCUMENTS 5,293,183 * 3/1994 Kim ..... 346/146
5,878,303 * 3/1999 Endo ..... 399/85
5,907,745 * 5/1999 Azuma et al. ..... 399/92

FOREIGN PATENT DOCUMENTS 61-135669 8/1986 (JP) .
62-116956 * 5/1987 (JP) .
7-49538 * 2/1995 (JP) .

* cited by examiner

*Primary Examiner*—Joan Pendegrass
(74) *Attorney, Agent, or Firm*—Oliff & Berridge, PLC

(57) ABSTRACT

Structuring the lower surface side of the body case of a printer to space heat generating sources apart from the cooling fan, improves the cooling efficiency and reduces the manufacturing cost of a printer. In a position close to a front portion of a main frame of a body case of a printer, an upper plate portion for an air duct extending in the transverse direction through the interior of the body case is formed in a generally inverted V shape in section. This isolates a processing unit incorporating a photosensitive drum, a developing device for forming a toner image on the photosensitive drum and a transfer roller, and a fixing unit to heat-fix the toner image after transfer onto paper from each other. Both lower ends of the upper plate portion having this shape are interconnected integrally to form an air duct. On the lower surface side of the main frame there is formed a receptacle portion communicating with both the air duct and an air passage for passing air to a drive motor. A power source is disposed in a rear space formed on the lower surface side of the main frame. A cooling fan is accommodated within the receptacle portion and is fixed with a bottom plate slantwise at an angle with respect to a horizontal plane.

20 Claims, 8 Drawing Sheets

COOLING DEVICE FOR IMAGE FORMING APPARATUS

BACKGROUND OF THE INVENTION

1. Field of the Invention

The present invention relates to a structure of a cooling device for an image forming apparatus of an electrostatic photography type mounted in a copying machine, a facsimile or a laser printer, for example.

2. Description of Related Art

A conventional image forming apparatus of this type is provided with a paper feed unit that feeds paper for the formation of an image, a processing unit that incorporates therein a photosensitive drum and a developing device for forming a toner image on the photosensitive drum, an exposure unit for forming an electrostatic latent image on the photosensitive drum, a fixing unit for heat-fixing the toner image after transfer onto the paper, a drive motor for driving rotating parts used in the above units, transmission gears, and a power source for a controller. These units are mounted to a main frame formed by a metallic plate or a synthetic resin. Further mounted to the main frame is a train of gears for the transmission of power to each of the above units. A case cover is formed of a synthetic resin so as to surround the front, rear, right and left sides of all of the main frame, the gear train and the aforesaid units. The case cover is fixed to the main frame with bolts or the like, thereby constituting a body case of the image forming apparatus.

For diminishing the heat generated from the above power source, drive motor and heating-type fixing unit, a cooling fan has heretofore been attached to the inner surface of the body case so that the direction of the wind generated from the fan is substantially horizontal or vertical.

However, in the case where the foregoing heat generating sources are located away from one another and at different heights within the body case, it is difficult to make the wind from one cooling fan advance in plural directions. Therefore, it is required to dispose cooling fans respectively at positions close to the heat generating sources, thus resulting in an increase in the manufacturing cost. Besides, it becomes necessary to ensure spaces for mounting those cooling fans and this gives rise to the problem that the size of the apparatus becomes larger.

SUMMARY OF THE INVENTION

The present invention has been accomplished for solving the above-mentioned and other problems. It is an object of the invention to provide a cooling device capable of cooling a plurality of heat generating sources efficiently by the use of a single cooling fan.

According to the present invention, a cooling device for an image forming apparatus is provided. The image forming apparatus includes a body case within which is a processing unit having at least a photosensitive body on which an electrostatic latent image is to be formed and a developing device for the formation of a toner image on the photosensitive body. An exposure unit for forming the electrostatic latent image on the photosensitive body, a fixing unit for heat-fixing the toner image after transfer onto paper, a drive motor for driving those units, and a power source are also provided in the body case. According to the cooling device, a cooling fan receptacle portion, an air passage for the drive motor in communication with the cooling fan receptacle portion, an air passage for the power source, and an air passage for the fixing unit, are formed within the body case of the image forming apparatus. In the cooling fan receptacle portion, a cooling fan is disposed slantwise with respect to the horizontal plane so that the wind generated by the cooling fan advances toward each of the above air passages.

Thus, the cooling wind generated by the cooling fan can be introduced into the plural air passages, i.e., air passage for the drive motor, air passage for the power source and air passage for the fixing unit, which are in communication with the cooling fan receptacle portion. Heat generating sources located away from one another can be cooled efficiently by a single cooling fan, and the reduction of the manufacturing cost can be attained by minimizing the number of cooling fans. Moreover, since the cooling fan is disposed slantwise with respect to the horizontal plane within the cooling fan receptacle portion, the direction of the cooling wind generated from the cooling fan has vectors in two directions, which include the horizontal direction and vertical direction. Consequently, even if the air passage for the drive motor, air passage for the power source and air passage for the fixing unit have different heights, it becomes easier to introduce the cooling wind to those air passages. Thus, the effect of decreasing the manufacturing cost can be attained by minimizing the number of cooling fans.

Preferably, in a first aspect of the present invention, a main frame is provided within the body case, and the foregoing various units are mounted on the upper surface side of the main frame, while the cooling fan receptacle portion, an air duct as the air passage for the fixing unit, the air passage for the drive motor and the air passage for the power source are formed integrally on the lower surface side of the main frame. The air duct, which is in communication with the cooling fan receptacle portion, is positioned between the processing unit and the fixing unit and extends in a direction intersecting the paper passing direction. Thus, the air duct is positioned so as to space the processing unit and the fixing unit from each other, whereby the radiant heat from the fixing unit side can be intercepted. The upper and lower surfaces of the main frame in the body case serve as a separator between the mounting portion for the above units and the air passages for cooling. Thus, the main frame can fulfill the aforesaid two functions. Further, the cooling fan receptacle portion, the air duct and the two air passages are formed integrally. Consequently, unlike the prior art, it is not necessary to use separate components for forming the air passages. Hence, the manufacturing cost can be reduced.

Preferably, in one aspect of the present invention, the cooling fan is abutted against both the lower surface of the main frame and a bottom plate that covers the lower portion of the main frame, and is supported thereby. In this way the posture of the cooling fan is maintained. Thus, the number of parts required for fixing the cooling fan becomes smaller and the labor required for assembly is minimized, so that the manufacturing cost can be reduced.

Preferably, in one aspect of the present invention, an upper plate portion of the air duct is formed in a generally inverted V shape in cross section. The lower ends of the upper plate portion having such a shape are interconnected with a separate partition plate to constitute the air duct. Since the air duct is disposed in such a manner that its upper plate portion causes the processing unit and the fixing unit to be spaced apart from each other, the radiant heat from the fixing unit side can be intercepted by the upper plate portion. At the same time, since the inner surface side of the upper plate portion is afforded the supply of cooling air that passes through the air duct, the temperature of the upper plate portion itself does not rise, and hence the cooling effect can be improved. Further, since part of the constituents of the air duct are common to the construction of the main frame, the number of parts required becomes smaller. Moreover, since the work required for creating the air duct is only the mounting of the partition plate, the assembly work is no longer troublesome, and the manufacturing cost can be reduced thereby.

Preferably, in one aspect of the present invention, the drive motor and the power source are disposed in proximity to each other on one side of the lower surface of the main frame. The air passage for the drive motor and that for the power source are formed as a common air passage. By this, the drive motor and the power source can be cooled efficiently with cooling air supplied from a single air passage, and the shape of the air passage can be simplified.

In a second aspect of the present invention, a cooling device is provided for an image forming apparatus, the image forming apparatus being provided with, within its main frame, a processing unit having at least a photosensitive body on which an electrostatic latent image is to be formed and a developing device for the formation of a toner image on the photosensitive body. An exposure unit for forming the electrostatic latent image on the photosensitive body, a fixing unit for heat-fixing the toner image after transfer onto paper, and a cooling fan are also provided within the main frame. On one side of the lower surface of the main frame are formed a receptacle portion for the cooling fan and an air passage for the supply of cooling air to both a power source and a drive motor, which is for supplying electric power to each of the above constituent units. The power source and the drive motor are disposed at a rear position on the lower surface side of the main frame so as to communicate with the cooling fan receptacle portion. On the main frame is formed an air duct at a position between the processing unit and the fixing unit and in communication with the cooling fan receptacle portion. The air duct extends in a direction intersecting the paper passing direction. The cooling fan is disposed slantwise with respect to the horizontal plane so that the cooling air generated from the fan advances toward both the air duct and the air passage.

The direction of the cooling air from the cooling fan, whose posture is thus held slantwise, is separated into upward and downward directions along the lower surface of the main frame. The upward cooling air passes through the air duct, so that the heat generated from the fixing unit is not transferred to the processing unit, while the downward cooling air passes through the air passage located at a lower position and is conducted to the drive motor and the power source, which are positioned in the rear portion of the lower surface side of the main frame. By this, the drive motor and the power source can be cooled. Thus, heat generating sources spaced apart from each other and having different heights can be cooled efficiently by a single cooling fan. Further, the number of cooling fans is minimized to reduce the manufacturing cost.

BRIEF DESCRIPTION OF THE DRAWINGS

A preferred embodiment of the present invention will be described in detail with reference to the following figures.

DETAILED DESCRIPTION OF PREFERRED EMBODIMENTS

Preferred embodiments of the present invention applied to a laser beam printer will be described hereunder with reference to the accompanying drawings. Of course, the invention can be applied to any type of image forming apparatus in which cooling is desirable, including but not limited to a thermal facsimile machine.

Figure 1:
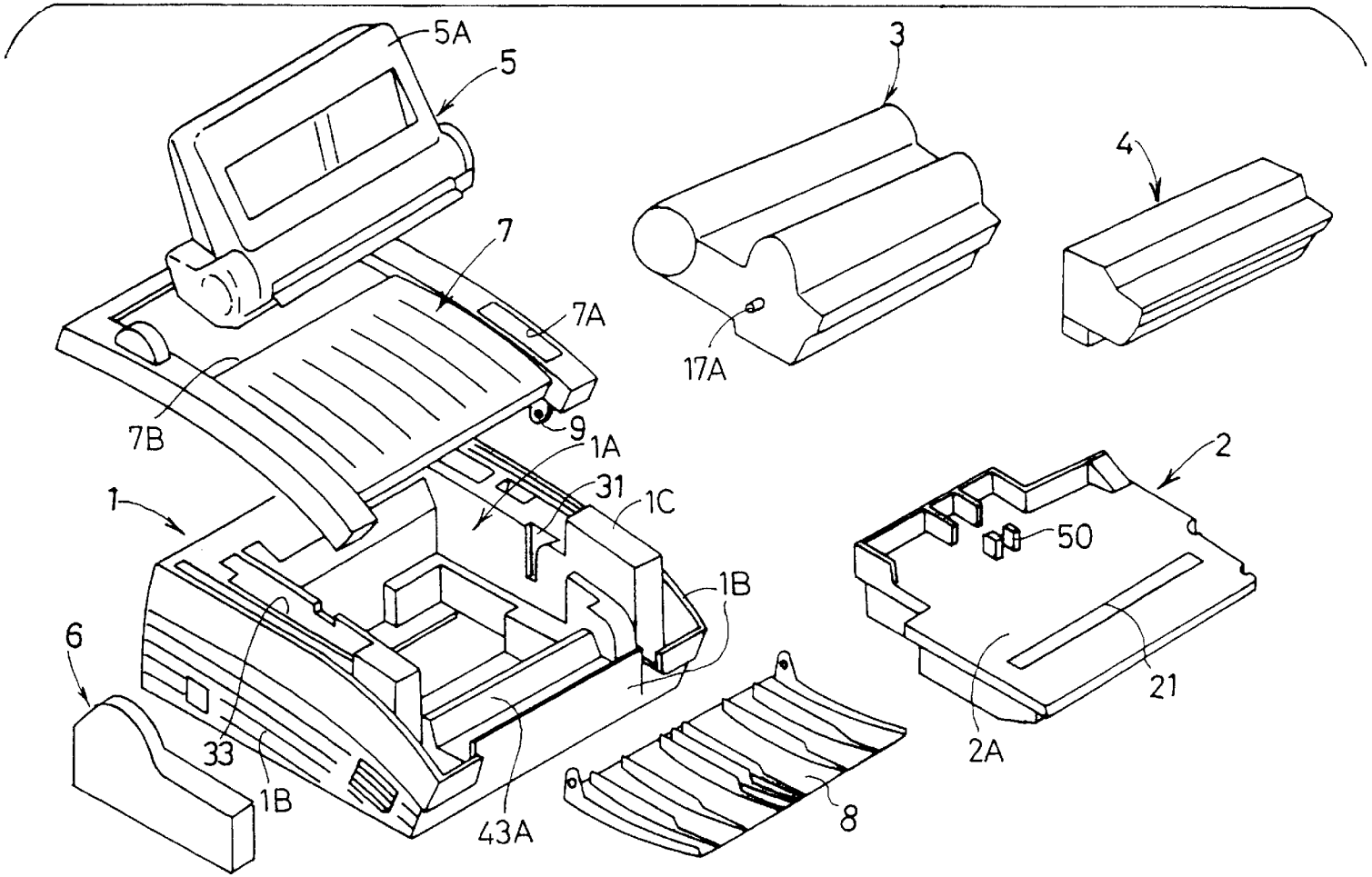
FIG. 1 is an exploded perspective view of principal components of a laser printer.
Figure 2:
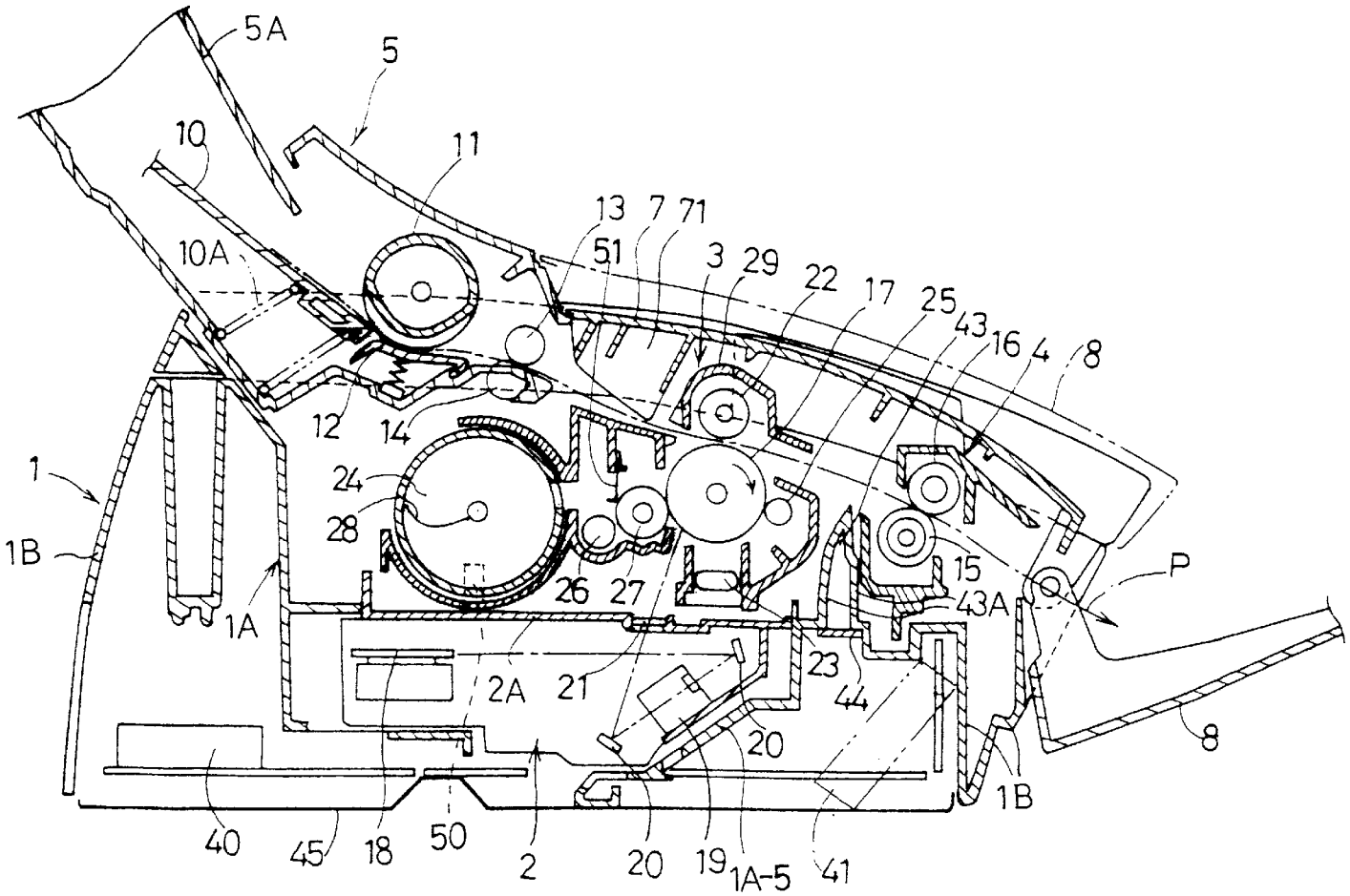
FIG. 2 is a schematic sectional view of the laser printer.

FIG. 1 is a perspective view of principal components of the laser printer as an image forming apparatus, and FIG. 2 is a schematic sectional side view of the laser printer. As shown in FIG. 1, a body case 1 of the printer comprises a main frame 1A of a synthetic resin and a main cover 1B also of a synthetic resin. The main cover 1B covers the exterior of four sides (front, rear and right, left sides) of the main frame 1A. To the main frame 1A are mounted, on the upper surface side thereof, a scanner unit 2, a processing unit 3, a fixing unit 4 and a paper feed unit 5. The main frame 1A and the main cover 1B are formed integrally by injection molding for example. A drive unit 6 including a drive motor and a gear train is inserted from below the body case 1 into a receptacle recess 33 formed between the left-hand inner surface of the main cover 1B and the left-hand side of the main frame 1A located near the inner surface in FIG. 1 and is fixed therein. The upper surface of the main frame 1A and that of the main cover 1B are covered with a top cover 7 made of a synthetic resin. The top cover 7 has a hole 7A for insertion therethrough of an operating panel 1C projecting upward on the right-hand side of the main frame 1A and also has a hole 7B for insertion therethrough of a base portion of the paper feed unit 5. A base portion of a paper discharge tray 8 is attached vertically pivotally to brackets 9 (only one is shown in FIG. 1) which are projectingly provided on both right and left sides of the front end of the top cover 7. When the paper discharge tray 8 is not in use, it can be folded toward the upper surface of the top cover 7 and can cover the same surface.

Sheets of printing paper P are placed in a stacked state within a feeder case 5A of the paper feed unit 5. The front end side of those sheets is urged toward a paper feed roller 11 by means of a support plate 10, which is urged with a biasing spring 10A disposed within the feeder case 5A. In this state, the sheets of printing paper are separated one by one by both the paper feed roller 11 and a separating pad 12, the roller 11 being rotated with the power transmitted from the drive unit 6. Each sheet of paper P after the separation is fed to the processing unit 3 by a pair of upper and lower resist rollers 13 and 14. In the processing unit 3, a toner image is formed on the surface of the sheet of paper P, which image is then fixed by both a heating roller 15 and a pressure roller 16 in the fixing unit 4. Thereafter, the sheet of paper P is discharged onto the paper discharge tray 8.

The processing unit 3 is disposed nearly centrally (in plan view) in the main frame 1A in the body case 1, the main frame 1A being in the form of a box whose upper surface is open. Below the processing unit 3, an upper support plate 2A of the scanner unit 2 is fixed with bolts or the like to a stay portion formed integrally on the upper surface side of a bottom plate 1A-5 of the main frame 1A. In the scanner unit 2 as the exposure unit, a laser beam source, a polygon mirror 18, a lens 19 and a reflecting mirror 20 are disposed on the lower surface side of an upper support plate 2A, which is formed of a synthetic resin. An oblong scanner hole is formed in the upper support plate 2A so as to extend along the axis of a photosensitive drum 17, and a glass plate 21 is provided to cover the scanner hole. Exposure is effected by radiating a laser beam through the glass plate 21 to the outer peripheral surface of the photosensitive drum 17 in the processing unit 3.

As shown in FIG. 2, the processing unit 3 comprises the photosensitive drum 17, a transfer roller 22, which is in abutment against the upper surface of the photosensitive drum 17, a charging device 23 of, for example, Scorotron type disposed under the photosensitive drum 17, a developing device disposed upstream of the photosensitive drum 17 and having a developing roller 27 and a feed roller 26, a developer (toner) feed portion, or a detachable toner cartridge 24, disposed upstream of the developing device, and a cleaning device 25 disposed downstream of the photosensitive drum 17. A charged layer is formed on the outer peripheral surface of the photosensitive drum 17 by the charging device 23. By scanning the charged layer with laser beam emitted from the scanner unit 2, an electrostatic latent image is formed. The developer (toner) stored in the toner cartridge 24 is agitated with an agitator 28 and then carried through the feed roller 26 onto the outer peripheral surface of the developing roller 27, being regulated in thickness by a blade 51. The developer thus carried on the developing roller 27 adheres to the electrostatic latent image formed on the photosensitive drum 17, whereby the electrostatic latent image is developed into a visible image. The visible image is then transferred onto the paper P passing between the transfer roller 22 and the photosensitive drum 17. The toner remaining on the photosensitive drum 17 is recovered by the cleaning device 25.

The processing unit 3 is cartridged by being incorporated into a synthetic resin case 29. The thus-cartridged processing unit 3 is removably mounted to the main frame 1A.

Figure 3:
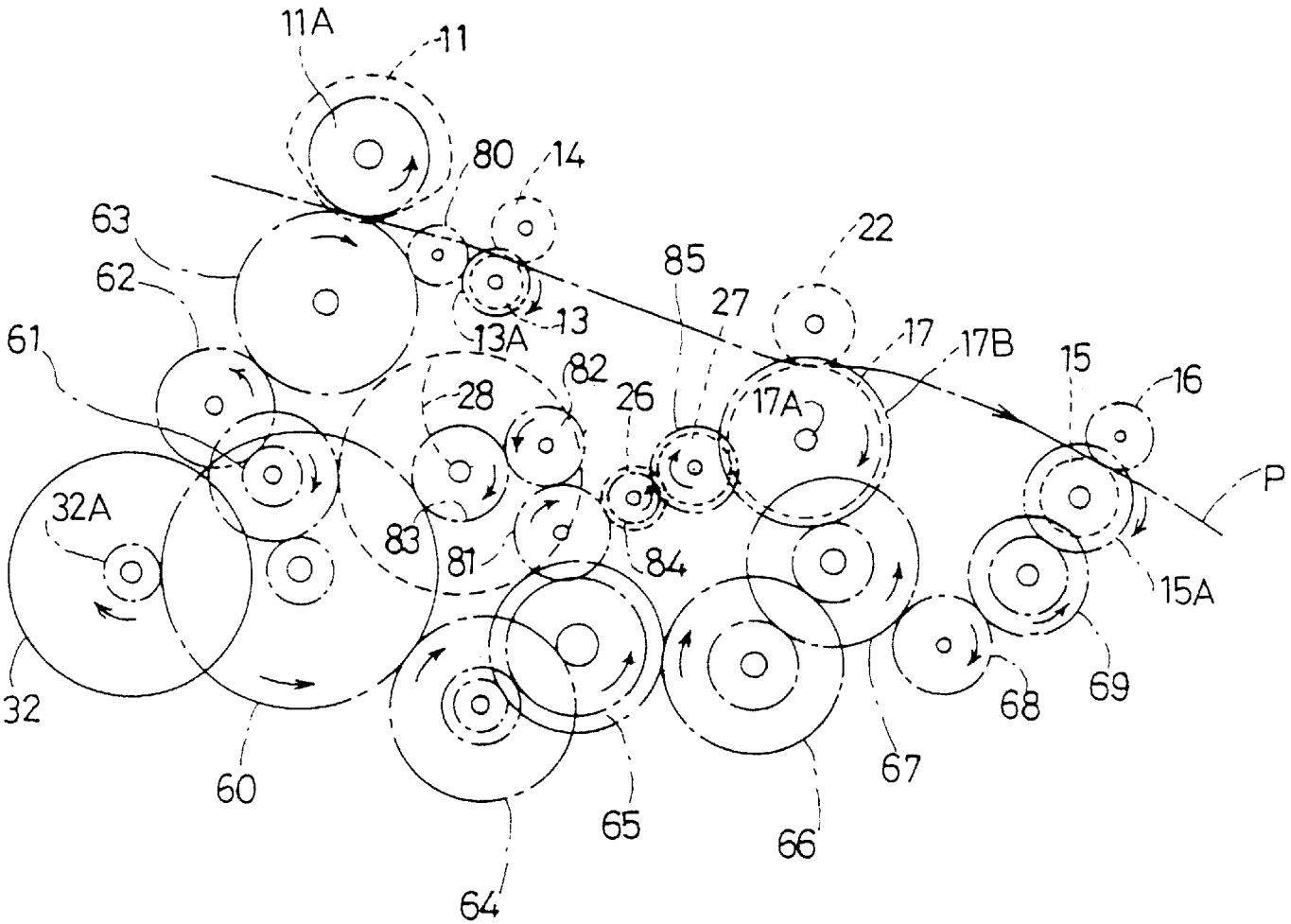
FIG. 3 illustrates a power transmission mechanism for the transmission of power to each constituent unit.

FIG. 3 shows a drive mechanism using a train of gears for driving the above-described units. Part of the drive mechanism is disposed on the left side as seen from the front of the printer body case 1, as the drive unit 6, which will be described later.

More specifically, a drive motor 32 capable of rotating in forward and reverse is fixed to the drive unit 6. A rotational force of a pinion gear 32A of the drive motor 32 is transmitted to a gear 62 and a double gear 63 via double gears 60 and 61 and further transmitted to a gear 11A, which drives the paper feed roller 11 in the paper feed unit 5. A rotational force of the gear 63 is transmitted to a gear 13A of the resist roller 13 via a transfer gear 80.

A rotational force of the double gear 60 is transmitted to a gear 17B of the photosensitive drum 17 via a treble gear 64 and double gears 65, 66 and 67. Further, a rotational force of the double gear 67 is transmitted to a gear 15A of the heating roller 15 in the fixing unit 4 via a gear 68 and a double gear 69.

On the other hand, a rotational force of the double gear 65 is transmitted to the agitator 28 via gears 81, 82 and 83 and is also transmitted to the feed roller 26 and the developing roller 27 via gears 81, 84 and 85.

Figure 8:
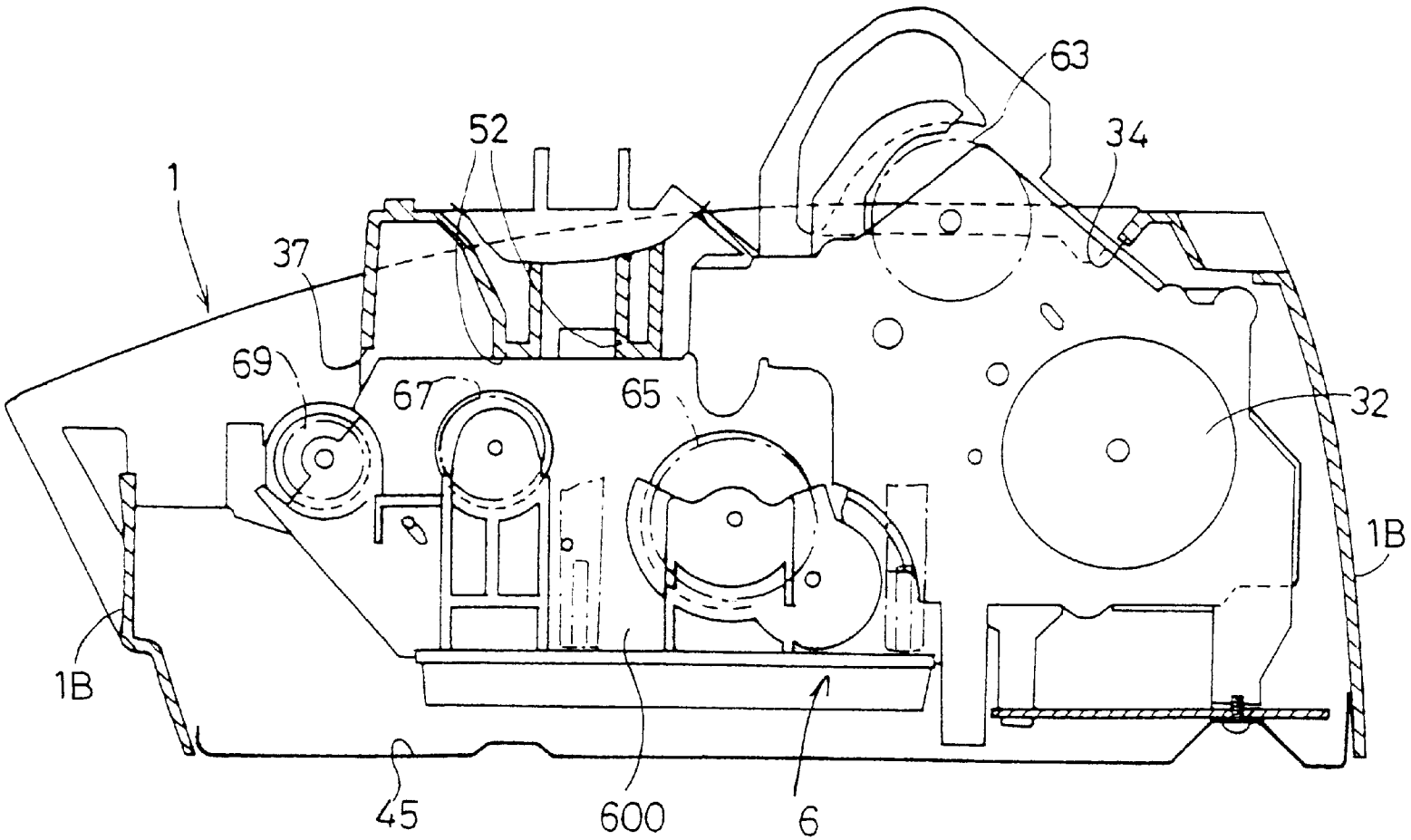
FIG. 8 is a sectional view as seen in the direction of arrow VIII—VIII in FIG. 4.

The drive unit 6 has a synthetic resin frame 600 as shown in FIG. 8. In the frame 600 are incorporated the drive motor 32, pinion gear 32A, double gears 60, 61, 63, 65, 66, 67 and 69, treble gear 64 and gears 62, 68.

Figure 4:
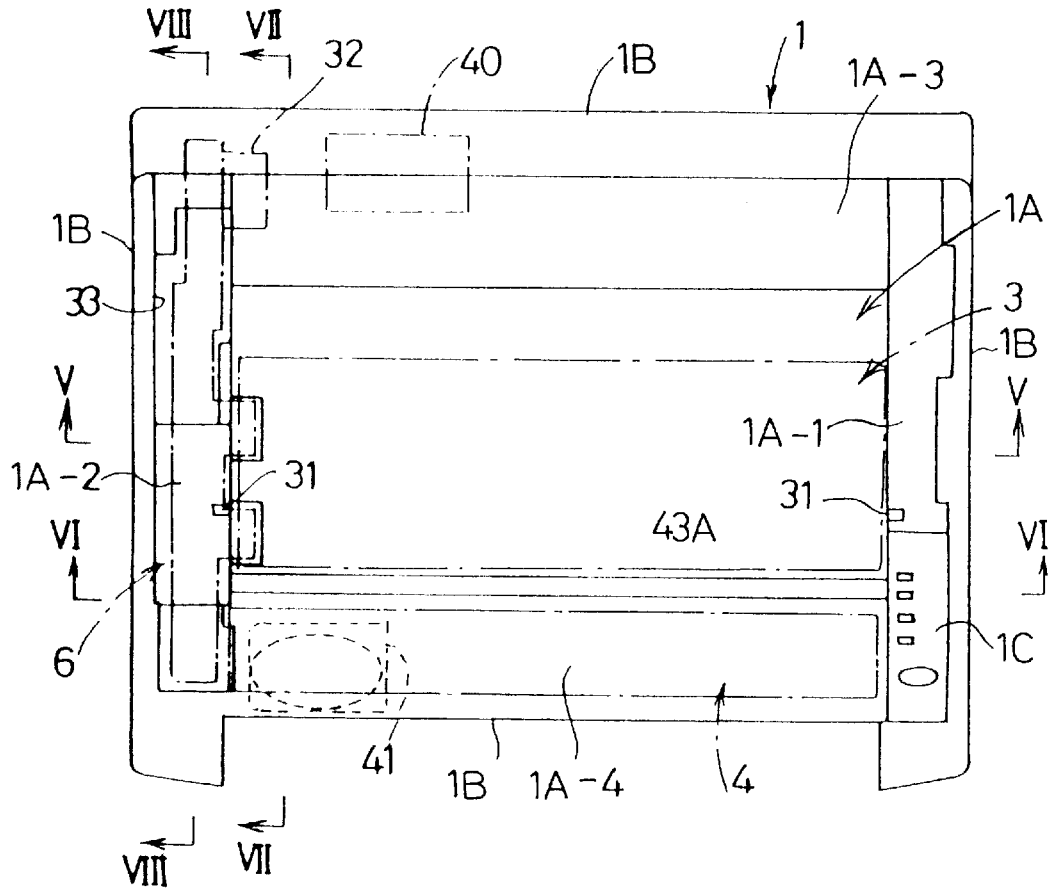
FIG. 4 is a plan view of a body case.
Figure 5:
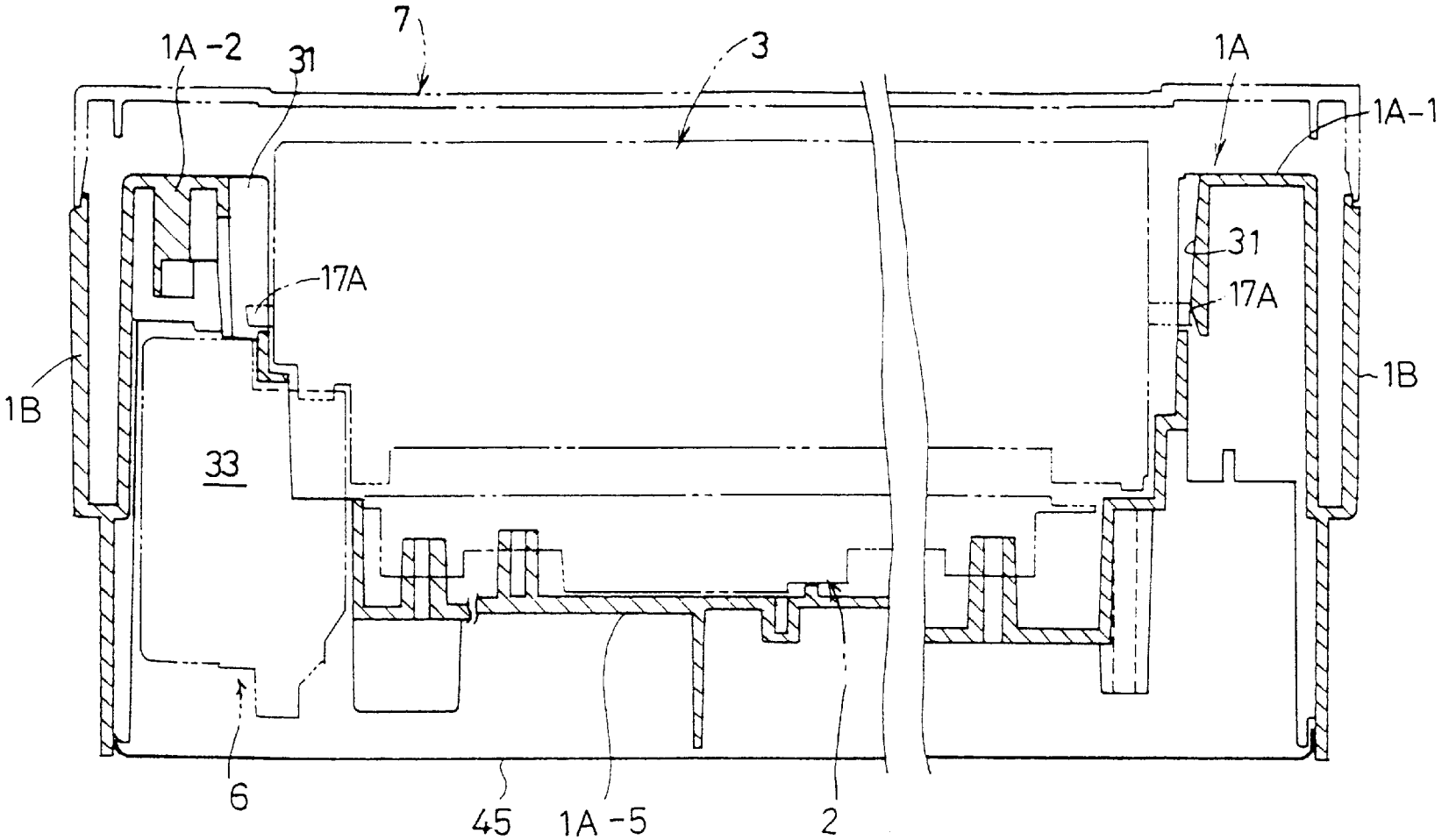
FIG. 5 is a side view as seen in the direction of arrow V—V in FIG. 4.
Figure 6:
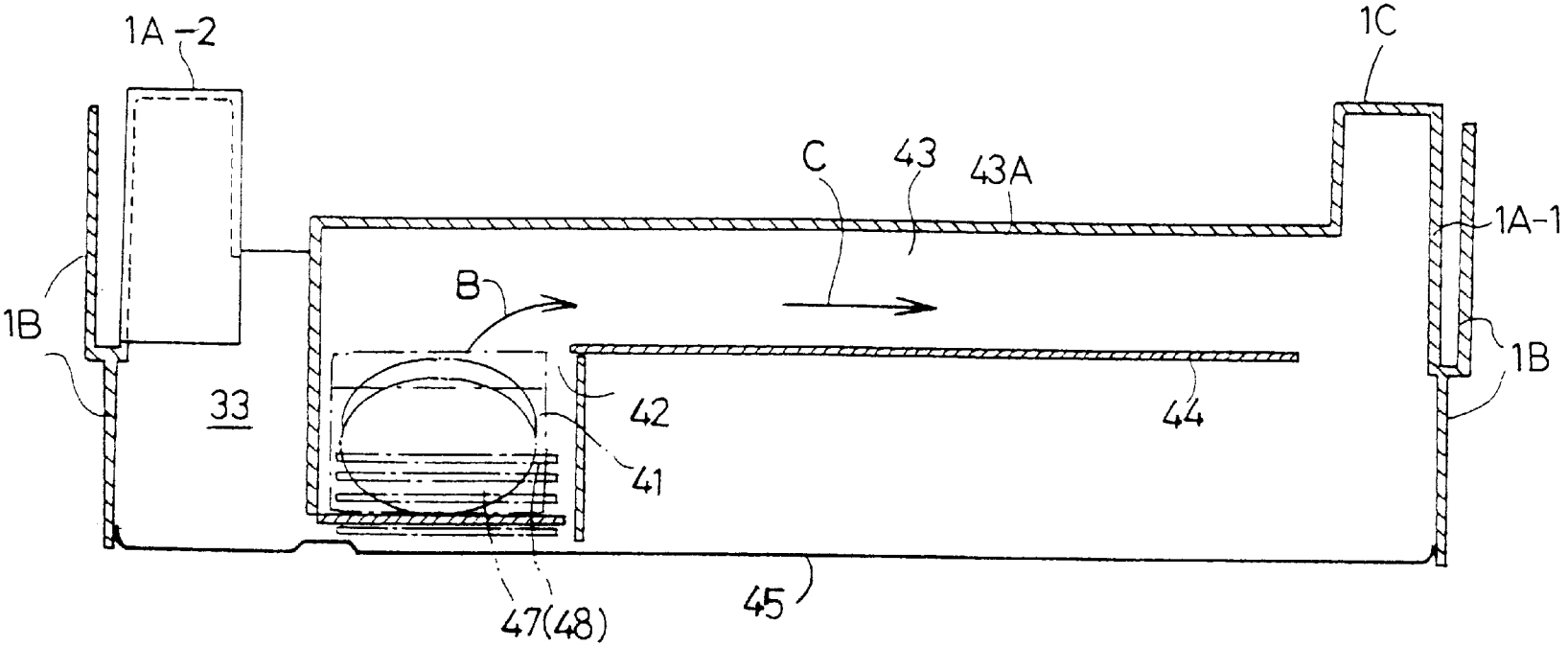
FIG. 6 is a sectional view as seen in the direction of arrow VI—VI in FIG. 4.

Now, with reference to FIGS. 2 to 8, a detailed description will be given of an integral construction of the main frame 1A and the main cover 1B. FIG. 4 is a schematic plan view of the body case 1. The main frame 1A is positioned centrally in the body case 1 in plan view and has a generally rectangular box-like shape whose upper surface is open. The main cover 1B is formed in an exteriorly adjacent manner to the front, rear and right, left sides of the main frame 1A. In a right-hand portion 1A-1 and a left-hand portion 1A-2, as seen in plan view, of the main frame 1A there are formed bearing slots 31, 31, respectively. Shaft portions 17A formed on both right and left sides of the photosensitive drum 17 in the processing unit 3 are respectively fitted in the bearing slots 31, 31 from above. The front half of the right-hand portion 1A-1 is formed with the operating panel 1C, while in the left-hand portion 1A-2 is formed the receptacle recess 33 into which the drive unit 6 is fitted from below. The receptacle recess 33 is partially formed with openings 34, 35, 36 and 37, through which the double gears 63, 65, 67 and 69, which are power transmitting gears for the aforesaid units, are allowed to face upward (see FIGS. 7 and 8). On the lower surface side (inner surface side) of the receptacle recess 33, as shown in FIG. 8, stays 52 for fixing the frame 600 of the drive unit 6 are projected integrally downward.

Figure 7:
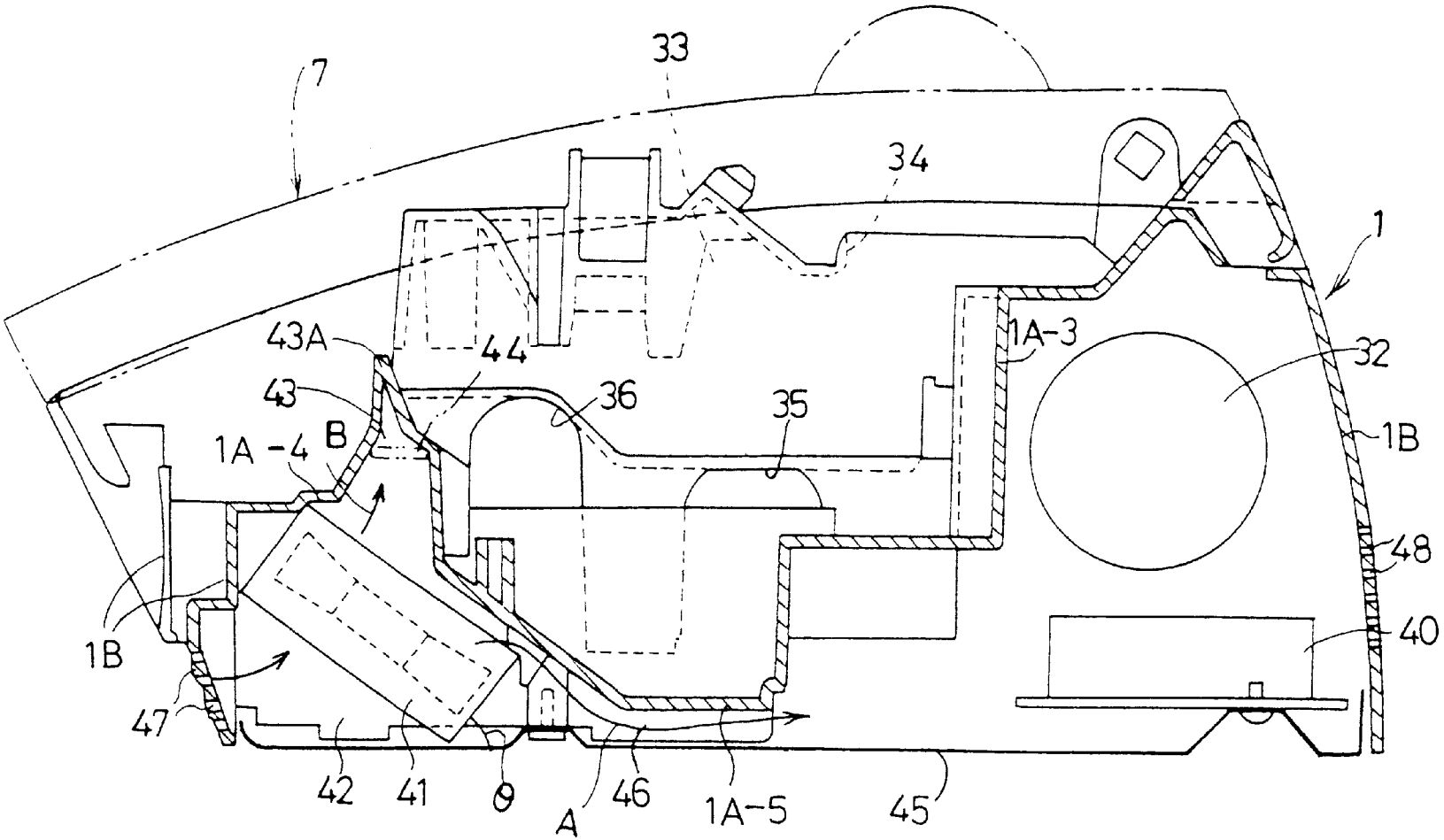
FIG. 7 is a sectional view as seen in the direction of arrow VII—VII in FIG. 4.

As shown in FIG. 7, below the connection between a rear portion 1A-3 of the main frame 1A and the rear surface of the main cover 1B there is a space for accommodating the drive motor 32 and the power source 40 in the drive unit 6.

Formed below the connection between a front portion 1A-4 of the main frame 1A and the front surface of the main cover 1B are a receptacle portion 42 for accommodation of a cooling fan 41 and an air duct 43 extending in a direction orthogonal to the passing direction of paper P. The receptacle portion 42 and the air duct 43 are in communication with each other. In this case, an upper plate portion 43A of the air duct 43 is formed in a generally inverted V shape in section. The upper plate portion 43A is positioned between the processing unit 3 and the fixing unit 4 both disposed on the upper surface side of the main frame 1A so that the radiant heat from the heating roller 15 in the fixing unit 4 is not transmitted to the processing unit 3 side (see FIGS. 2, 4, 6 and 7). As shown in FIGS. 2 and 7, the lower ends of the upper plate portion 43A, which is generally inverted V-shaped in section, are interconnected with a resinous partition plate 44. The space enclosed by the upper plate portion 43A and the partition plate 44 acts as the air duct 43, with cooling air passing through the interior of the air duct in the direction of arrow shown in FIG. 6.

The scanner unit 2 is supported by the bottom plate 1A-5 of the main frame 1A, and an air passage 46 is formed by both a portion (close to the left-hand portion 1A-2) on the lower surface side of the bottom plate 1A-5 and a metallic bottom plate 45 so as to communicate with the space where the drive motor 32 and the power source 40 are accommodated (see FIG. 7). The bottom plate 45 is engaged with the front and rear lower ends of the main cover 1B to close the bottom portion between the lower ends. Air inlet ports 47 and air outlet ports 48 are, respectively, on the front and rear sides of the main cover 1B.

In the receptacle portion 42, the cooling fan 41 is supported and fixed by the lower surfaces of the main frame 1A and main cover 1B and the bottom plate 45. The posture (air blowing direction) of the cooling fan 41 is held slantwise at an appropriate angle θ(about 54 to 60 degrees in this embodiment) relative to the horizontal plane. The cooling fan 41 is face to face with an inclined lower surface portion of the bottom plate 1A-5 of the main frame 1A through an appropriate spacing (see FIG. 7).

In the construction described above, when the cooling fan 41 is driven, the outside air is sucked in through the air inlet ports 47 formed on the front side of the main cover 1B. Then, cooling air generated from the cooling fan 41 goes down along the inclined lower surface portion of the bottom plate 1A-5 of the main frame 1A communicating with the receptacle portion 42. The cooling air then advances in the direction of arrow A in FIG. 7 through the bottom air passage 46 and efficiently cools the power source 40 and the drive motor 32 both disposed in the rear portion of the body case 1. The cooling air from the cooling fan 41 also moves upward in the direction of arrow B in FIG. 7 from the receptacle portion 42, then passes through the air duct 43 in the direction of arrow C (see FIG. 6), passes below the right-hand portion 1A-1 and is conducted to the rear side of the main frame 1A so, the inner surface of the upper plate portion 43A is cooled. Consequently, there is no increase in temperature throughout the overall length of the upper plate portion 43A, which is arranged to be long in a sideways orientation to isolate the processing unit 3 and the fixing unit 4 from each other. Thus, the heat of the heating roller 15 in the fixing unit 4 does not exert any bad influence on the processing unit 3.

Besides, the upper plate portion 43A of the air duct 43, which portion has a generally inverted V shape in section, functions as a reinforcing rib at the front portion of the main frame 1A. Thus, it is possible to improve the rigidity of the main frame 1A and hence the rigidity of the body case 1, which is integral with the main cover 1B.

Further, since the body case 1 is an integral body of the main frame 1A and the main cover 1B, formed by using a synthetic resin, it is not necessary to perform the operation for attaching the main cover 1B to the main frame 1A required in the prior art. Besides, the air duct can also be formed in an integral manner. Therefore, the number of components required is minimized, and it is possible to reduce the manufacturing cost.

An upwardly projecting toner sensor 50 is provided on the upper support plate 2A of the scanner unit 2. The toner sensor 50, which comprises a pair of a light emitting portion and a light sensing portion, faces a recess formed in the lower surface of the toner cartridge 24 in the processing unit 3 so that the toner sensor 50 can detect whether the toner is present or not in the toner cartridge 24. At the time of replacing the toner sensor 50 with a fresh one due to failure of the sensor, for example, all that is required is removal of the scanner unit 2 from the main frame 1A. According to the prior art, the toner sensor 50 is mounted to the main frame 1A, in which case it is required to remove the bottom plate 45 and then perform the toner sensor removing and mounting operation from the main frame 1A side.

Further, downward ribs 71 are formed on the lower surface of the top cover 7 made of a synthetic resin. The ribs 71 face the upper surface of the paper P conveyance path extending from the paired resist rollers 13 and 14 in the paper feed unit 5 to the transfer roller 22 in the processing unit 3, to form a chute for the paper P. In the event of paper jam, therefore, the jammed paper P can be removed easily by merely removing the top cover 7.

While advantageous embodiments have been chosen to illustrate the invention, it will be understood by those skilled in the art that various changes and modifications can be made therein without departing from the scope of the invention as defined in the appended claims.

What is claimed is:

1. A cooling assembly for an image forming apparatus comprising:

a case that houses a plurality of heat generating mechanisms;

a cooling fan that generates cooling air; and air passages that extend adjacent to the plurality of heat generating mechanisms and channel cooling air from the cooling fan to the plurality of heat generating mechanisms, one air passage extending longitudinally with respect to the case and another air passage extending laterally with respect to the case;

wherein an air blowing direction of the cooling fan is at a non-zero angle with respect to a horizontal plane so that the cooling air generated by the cooling fan advances toward each of the plurality of air passages.

2. The cooling assembly of claim 1, wherein one of the air passages is formed by an air duct disposed in the case and has an upper plate portion formed as a generally inverted V shape with a pair of legs and a lower partition plate that interconnects the pair of legs of the V shape upper plate portion.

3. The cooling assembly of claim 1 wherein the cooling fan is the only cooling source in the image forming apparatus.

4. A cooling assembly for an image forming apparatus comprising:

a case that houses a plurality of heat generating mechanisms, wherein the heat generating mechanisms disposed in the case include a processing unit having at least a photosensitive body on which an electrostatic latent image is formed and a developing device for forming a toner image on the photosensitive body, an exposure unit that forms the electrostatic latent image on the photosensitive body, a fixing unit for heat-fixing the toner image after the image is transferred onto paper, a drive motor that drives the processing unit, the exposure unit and the fixing unit, and a power source;

a cooling fan that generates cooling air; and a plurality of air passages that extend adjacent to the plurality of heat generating mechanisms and channel cooling air from the cooling fan to the plurality of heat generating mechanisms, wherein the plurality of air passages include an air passage for the drive motor, an air passage for the power source and an air passage for the fixing unit, and wherein an air blowing direction of the cooling fan is at a non-zero angle with respect to a horizontal plane so that the cooling air generated by the cooling fan advances toward each of the plurality of air passages.

5. The cooling assembly of claim 4, wherein the case includes a main frame and a main cover coupled to the main frame to cover at least a portion of the main frame, the main frame having an upper portion and a lower portion, the lower portion having a receptacle formed therein that houses the cooling fan, wherein the processing unit, the exposure unit and the fixing unit are mounted in the upper portion of the main frame, and wherein the drive motor and the power source are mounted in the lower portion of the main frame, and wherein one of the air passages extends in the lower portion and another of the air passages extends in the upper portion.

6. The cooling assembly of claim 5 wherein the air passage extending in the upper portion is located between the processing unit and the fixing unit.

7. The cooling assembly of claim 6 wherein the air passage extending in the upper portion between the processing unit and the fixing unit extends from one side of the image forming apparatus to the other side of the image forming apparatus in a direction transverse to a paper feeding direction.

8. The cooling assembly of claim 6, wherein the air passage extending in the upper portion is formed by an air duct formed in the main frame by an upper plate portion formed as a generally inverted V shape with a pair of legs formed as part of the main frame and a lower partition plate that interconnects the pair of legs of the V shape upper plate portion.

9. The cooling apparatus of claim 5, further comprising a bottom plate that forms the cooling fan receptacle with the main frame and at least one of the air passages in the lower portion of the main frame, wherein the cooling fan closely faces a lower surface of the main frame such that cooling air generated by the cooling fan is diverted in at least two directions.

10. The cooling assembly of claim 9 wherein the lower surface of the main frame that the cooling fan faces is inclined with respect to a horizontal plane.

11. The cooling assembly of claim 5 wherein the main cover includes an air inlet port and an air outlet port.

12. The cooling assembly of claim 5 wherein the air passages are ducts formed in an outer surface of the main frame.

13. The cooling assembly of claim 5 wherein at least one of the air passages is formed as a duct between an outer surface of the main frame and an inner surface of the main cover.

14. The cooling assembly of claim 13 wherein the main frame and the main cover are integrally formed as a one-piece unit.

15. The cooling assembly of claim 4 wherein the drive motor and the power source are disposed in proximity to each other on one side of a lower part of the case and share a common air passage for cooling.

16. A cooling device for an image forming apparatus comprising:

a main frame and a main cover attached to thereto, the main frame having an upper portion and a lower portion and the main cover having an air inlet port and an air outlet port;

an image processing unit disposed in the main frame for forming an image to be developed for printing;

a fixing unit disposed in the main frame for heat-fixing the image onto a recording medium;

a cooling fan;

a drive unit for driving the image processing unit, fixing unit and the cooling fan; and a power source for powering the drive unit, wherein one side of the lower portion of the main frame includes a receptacle portion formed therein that accommodates the cooling fan and has a plurality of air passages formed therein communicating with the cooling fan receptacle to pass cooling air to the image processing unit, fixing unit, drive unit and power source.

17. The cooling device of claim 16 wherein the receptacle portion of the main frame is formed by an outer angled surface of the main frame that faces the cooling fan, and wherein the cooling fan is disposed to create cooling wind that blows at an angle from a horizontal plane with the angled surface of the main frame deflecting and diverting the cooling wind in a plurality of directions.

18. The cooling device of claim 16 wherein one of the air passages is formed by a V-shaped groove in the main frame extending between the image processing unit and the fixing unit to isolate and cool them.

19. The cooling device of claim 16 wherein a bottom plate is attached to the main frame and one of the air passages is formed between the main frame and the bottom plate and passes adjacent to the drive unit and the power source.

20. The cooling device of claim 16 wherein the plurality of air passages are interconnected and include an air passage extending in a longitudinal direction and an air passage extending in a lateral direction.

* * * * *